US006422410B2

(12) United States Patent
Neuhaus

(10) Patent No.: US 6,422,410 B2
(45) Date of Patent: Jul. 23, 2002

(54) REFUSE CONTAINER

(75) Inventor: Egbert Neuhaus, Arnsberg (DE)

(73) Assignee: Westermann KG, Arnsberg (DE)

( * ) Notice: Subject to any disclaimer, the term of this patent is extended or adjusted under 35 U.S.C. 154(b) by 0 days.

(21) Appl. No.: 09/780,994

(22) Filed: Feb. 9, 2001

(30) Foreign Application Priority Data

Feb. 15, 2000 (DE) ..... 200 02 730

(51) Int. Cl.[7] ..... B65D 21/02
(52) U.S. Cl. ..... 220/23.89; 220/908.3
(58) Field of Search ..... 220/908.3, 908.1, 220/23.89, 23.87

(56) References Cited

U.S. PATENT DOCUMENTS 1,380,282 A * 5/1921 Richardson ..... 220/908
1,568,901 A * 1/1926 Mickey ..... 220/908.3
2,125,122 A * 7/1938 Mongiello ..... 220/908.3
3,191,798 A * 6/1965 White et al. ..... 220/908.3
5,097,750 A * 3/1992 Oldham ..... 220/908

FOREIGN PATENT DOCUMENTS

DE 29802112 6/1999

* cited by examiner

*Primary Examiner*—Joseph M. Moy
(74) *Attorney, Agent, or Firm*—Martin A. Farber

(57) ABSTRACT

A refuse container (1) having a dome-like head (3) and an introduction opening (4) which is formed in the dome and under which a hopper section (10) is located as a refuse-introduction slope, the hopper opening (11) of which is directed toward an inner bin (14), which is disposed under the head (3), and also having an outer container (2) which accommodates the inner bin (14). The outer container (2) widens in the direction of the head (3), with the formation of an inner introduction slope (S), and in the base region (21) of the inner bin (14), the outer container (2) is adapted to the outer dimensions of the inner bin (14), the inserted inner bin (14) overlapping (U), with its upper border (13), a collar (12) of the hopper section (10), the collar projecting into the interior (15) of the inner bin (14). The inner bin (14) is thus supported in the outer bin (2) with plug-in guidance and positional centering.

4 Claims, 5 Drawing Sheets

X
4
5
3
16
1
9
10
12
30
7
13
2
29
15
14
20
18
21
19
17
35
X

REFUSE CONTAINER

FIELD AND BACKGROUND OF THE INVENTION

The invention relates to a refuse container having a dome-like head and an introduction opening which is formed in the dome and under which a hopper section is located as a refuse-introduction slope, the hopper opening of which is directed toward an inner bin, which is disposed under the head, and also having an outer container which accommodates the inner bin.

A refuse container of the type is known from German Utility Model 29 802 112.

SUMMARY OF THE INVENTION

It is an object of the invention to develop such a refuse container in a functionally advantageous manner.

This object is achieved first and foremost in the case of a refuse container of the above-mentioned type, wherein the outer container widens in the direction of the head, with the formation of an inner introduction slope, and in the base region of the inner bin, the outer container is adapted to the outer dimensions of the inner bin, the inserted inner bin overlapping, with its upper border, a collar of the hopper section, this collar projecting into the interior of the inner bin. This results in the inner bin being satisfactorily centered and secured in position in relation to the outer container. The downwardly projecting collar of the hopper section of the head always locates a center-oriented upper border of the inner bin. The overlapping engagement of the border and collar provides a first securing plane, which is located in the head region. The second securing plane is provided in the base region of the outer container. The refuse container with properly inserted inner bin can thus easily be transported without this inner bin tilting in the outer container, this being the case even when the refuse container, which is realized as an upright-standing unit, is carried virtually horizontally. A relatively wide annular space may remain in the vicinity of the head, this annular space being bridged in any case by the hopper section. With the head removed, one can easily reach into this annular space in order to insert the inner bin or to remove the same. The hopper section in the form of a rotationally symmetrical refuse-introduction slope, in addition, directs the refuse cleanly via the collar of the hopper section. The invention also provides that, in the base region of the inner bin, the outer container forms a reduced-diameter section which widens into a pedestal disposed underneath. Such a pedestal ensures the standing stability of the refuse container. The pedestal may be formed by extension arms which project in a crosswise manner transversely to the standing axis of the refuse collector. Finally, it is also provided that, in the region of the reduced-diameter section, the outer container has a horizontal partition wall which supports the inner bin. Since the pedestal is otherwise open at the standing-surface end, it is easily possible to grip below the border of this pedestal in order to carry the refuse container.

BRIEF DESCRIPTION OF THE DRAWINGS

The refuse container is explained in more detail hereinbelow with reference to an exemplary embodiment illustrated in the drawing, in which.

DETAILED DESCRIPTION OF THE PREFERRED EMBODIMENT

Figure 1:
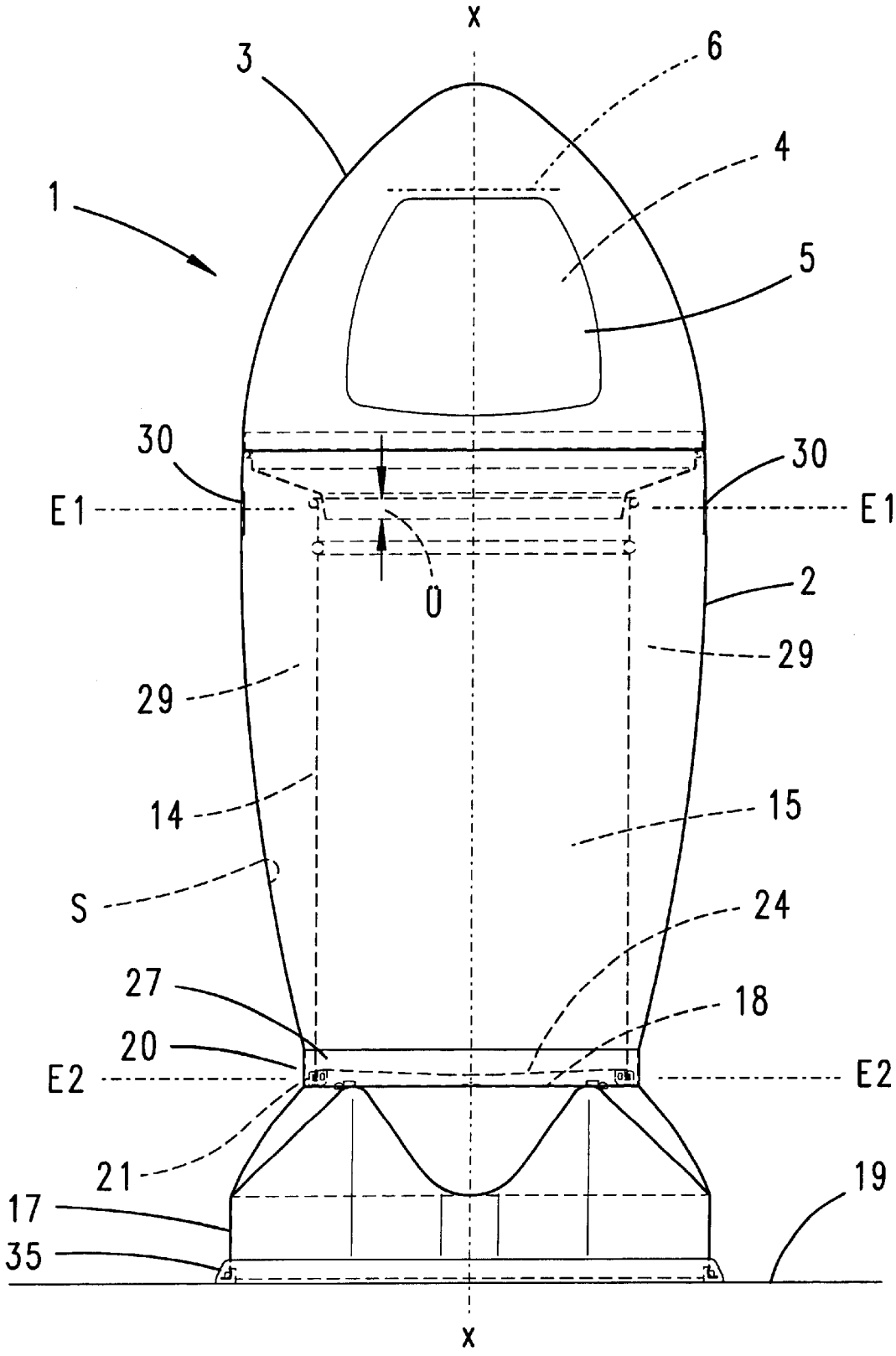
FIG. 1 shows a front view of the refuse container with the head in the closed position, to be precise as seen in the direction of the introduction opening.
Figure 2:
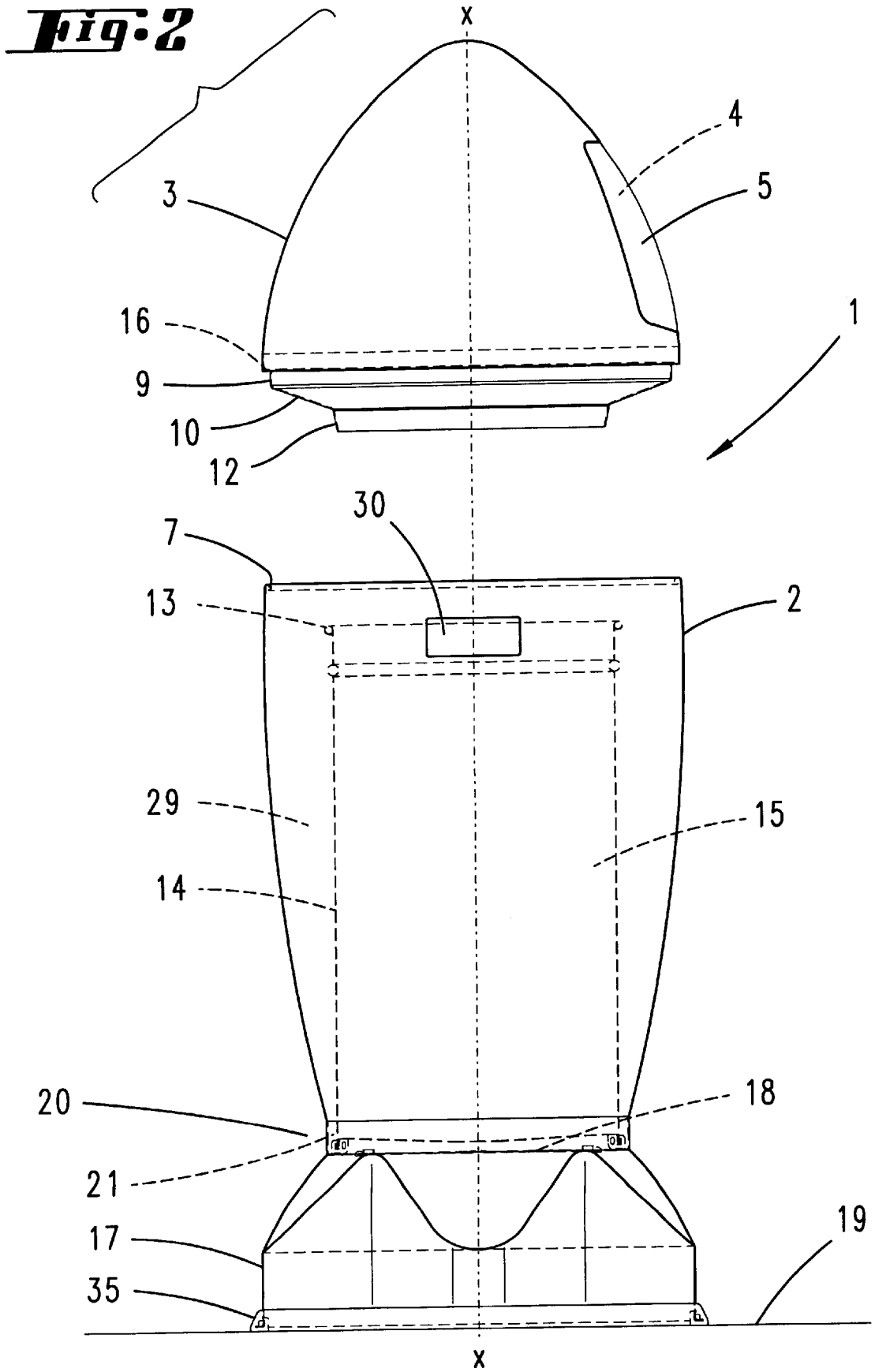
FIG. 2 shows the refuse container rotated through 90° and with the head now removed, thus giving access for the removal or introduction of the inner bin.
Figure 3:
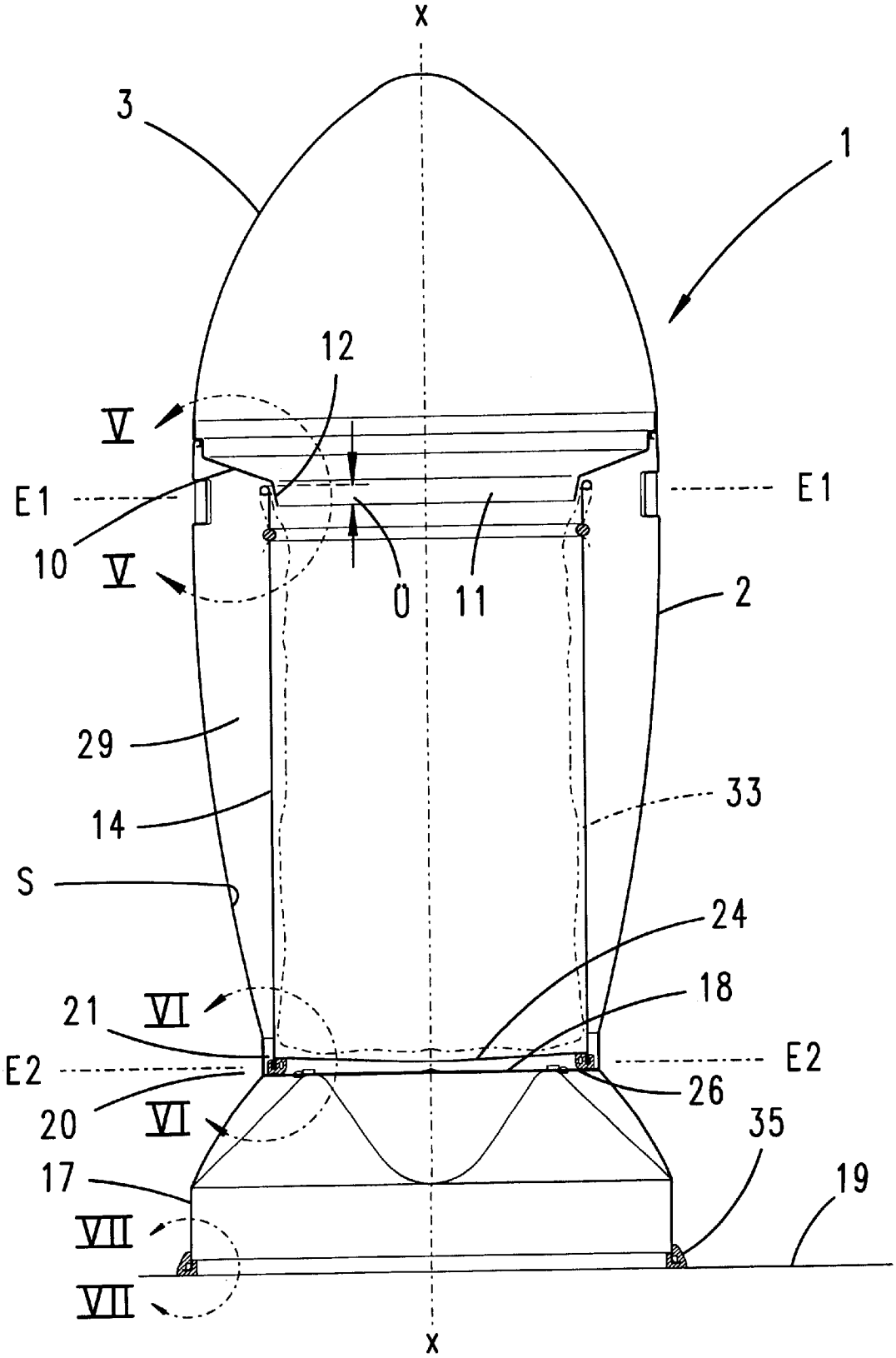
FIG. 3 shows a vertical section through the refuse container in the closed position according to FIG. 1.

The waste collector illustrated, designated as refuse container 1 throughout, is realized as an upright-standing unit. Its vertical length corresponds to three times the maximum diameter.

The refuse container 1 has an outer container 2. The latter terminates at the top with a dome-like head 3.

In terms of contour, the head 3 is a hyperbola-like, rotationally symmetrical dome. The latter can be achieved by deep-drawing or thermoforming.

The head 3 forms the access region for the introduction of the refuse. It has an introduction opening 4 in its relatively steeply downwardly sloping wall region. The introduction opening is closed by a cover. Use is made of a swing-action cover 5. The latter is mounted in the head 3 along its upper edge. The articulation axis appears there as a horizontal chain-dotted line and has the reference numeral 6.

The rear side of the swing-action cover 5, this rear side being aligned, in the stop-defined closed position, with the outer contour of the dome-like head 3, fits in harmoniously. The swing-action cover 5 is spring-loaded in the closing direction.

The outer container 2 is similar to a missile body or, more precisely, a half-barrel-like tub. The upper border 7 of the latter is flanged. The corresponding rolled formation can clearly be gathered from FIG. 5. The opening 8, which is thus circumscribed by rounded edges, of the outer container 2 may thus have the head 3, functioning as a lid, inserted into it or positioned on it. This can even go as far as acting as an odour seal.

The plug-in protrusion used in this respect is a plug-in protrusion 9 which is connected on the inside to the lower border of the head 3.

The rotationally symmetrical plug-in protrusion 9 continues downward into a hopper section 10. In spatial terms, the latter is located at a considerable vertical spacing under the plane or lower edge of the introduction opening 4. The hopper slope is inclined to a sufficient extent for refuse coming into contact with it to slide off.

The hopper section 10, which serves as a refuse-introduction slope, terminates in a central hopper opening 11. This is formed by a downwardly directed collar 12.

The collar 12 tapers in the direction of the mouth of the hopper opening 11. The collar wall forms a cone. The slope of the latter runs more steeply in relation to the longitudinal center axis x—x of the refuse container 1 than that of the hopper section 10, which adjoins at the head end.

Figure 5:
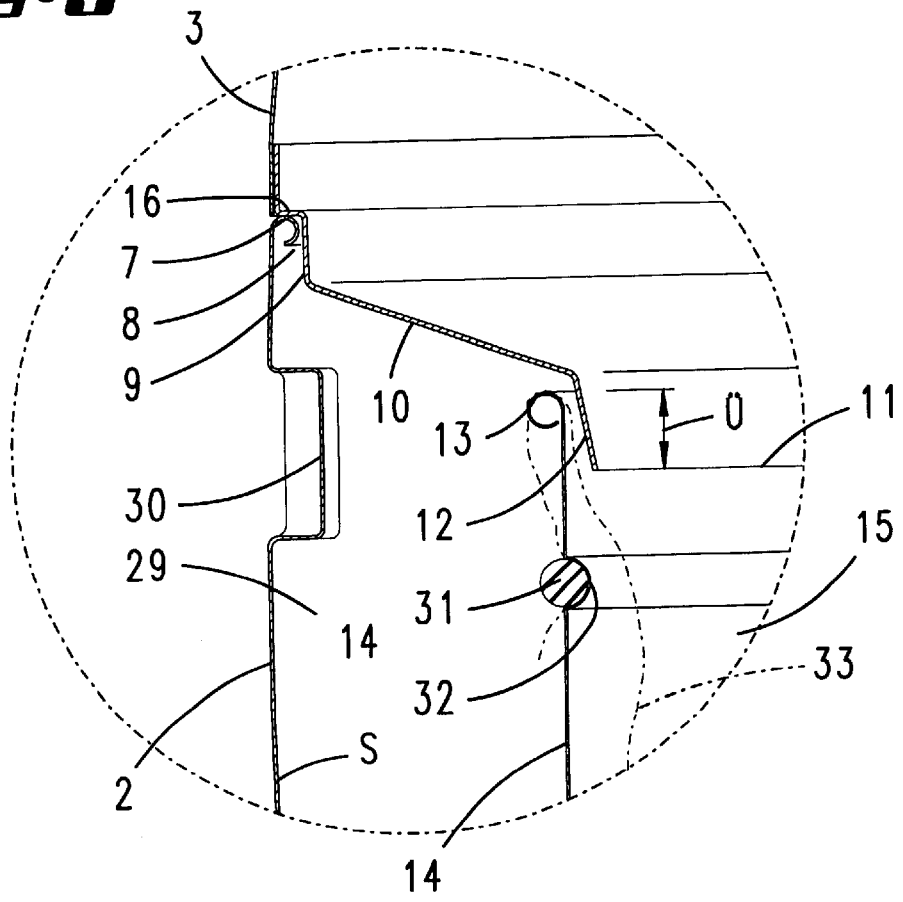
FIG. 5 shows the enlargement V—V from FIG. 3.
Figure 6:
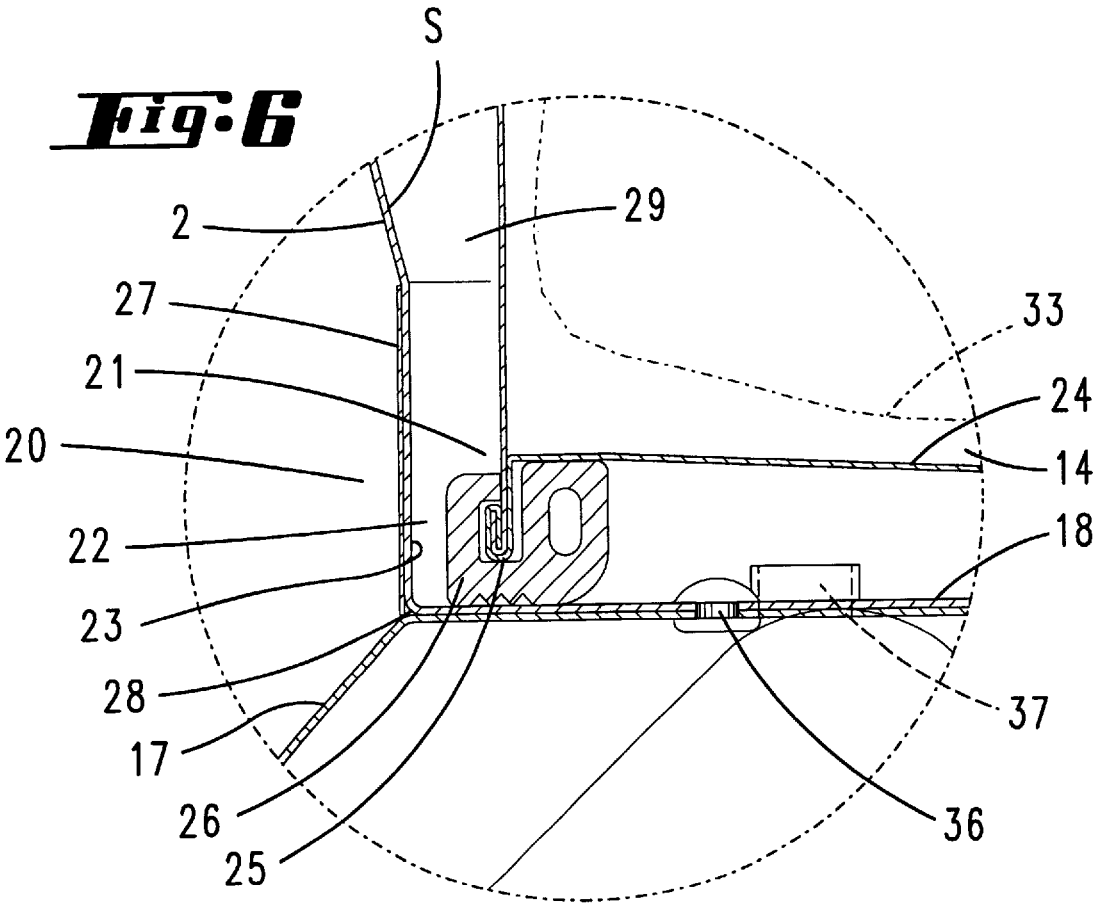
FIG. 6 shows the enlargement VI—VI from FIG. 3.
Figure 7:
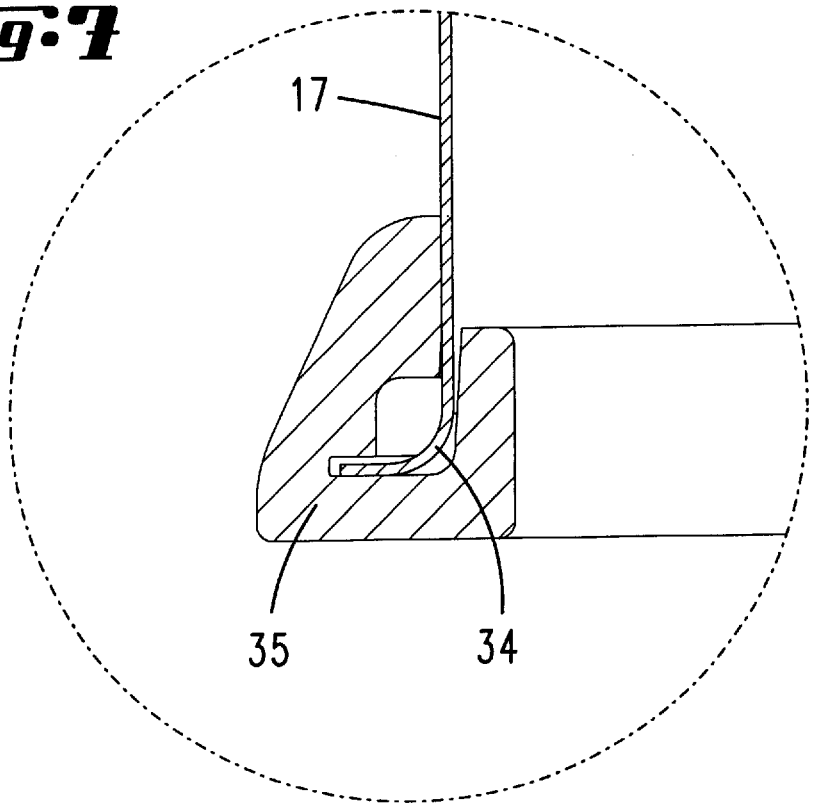
FIG. 7 shows the enlargement VII—VII from FIG. 3.

As can be gathered from FIG. 5, a border 13 of an inner bin 14 positioned in the outer container 2 projects peripherally beyond the downwardly directed collar 12 of the hopper section 10. This results in the refuse entering reliably into the interior 15 of the inner bin 14. The correspondingly occurring axial/radial overlapping of the collar 12 and of the inner-bin mouth, that is to say of the border 13, is designated U.

The slightly conical configuration of the collar 12 allows the latter to find its way in. The basic direction is already predetermined by the plug-in protrusion 9.

At the head end, the plug-in protrusion 9 continues into an outwardly directed shoulder 16. The latter forms, with its underside, the support for the head 3 to rest on.

In addition to such a first horizontal centering plane E1—E1, which is located in the upper region of the upright-standing unit, there is also a second horizontal centering plane E2—E2, between the outer container 2 and inner bin 14, provided in the lower transition region between the body of the outer container 2 and a pedestal 17 at the standing-surface end. Even with the refuse container 1 tilted, there is no sliding between the two elements 2, 3/14.

The inner bin 14 rests on a horizontal partition wall 18 between the pedestal 17, which is open in the direction of the standing surface 19 of the refuse container 1.

The horizontal partition wall 18, formed in part by a top of the pedestal 17 and an inwardly drawn inner border of the outer container 2, extends in the region of a reduced-diameter section 20. The corresponding narrowing can clearly be gathered, for example, from FIG. 1. Extending from the region of the reduced-diameter section 20, the wall of the outer container 2 diverges in the direction of the head 3 and the wall of the pedestal 17 diverges in the direction of the standing surface 19. The pedestal height corresponds approximately to the radius of the maximum diameter of the refuse collector; the maximum external diameter is located in the region of the centering plane E1—E1.

Corresponding conditions are present in the interior at least in respect of the body, that is to say of the outer container 2. This continuously arcuate tapering of the wall, which extends to the reduced-diameter section 20, is expediently utilized in respect of the second centering plane E2—E2 explained above.

For the insertion of the inner bin 14, in the region of the opening 8 of the outer container 2, the inside diameter available is larger than the external diameter of the substantially cylindrical inner bin 14. The difference in diameter, occurring in the direction of the longitudinal center axis x—x, on the inside of the outer container 2 is used in order to form an inner introduction slope S. In the base region 21 of the inner bin 14, the wall of the outer container 2, this wall clearly widening in the direction of the head 3, is adapted to the outer dimensions of the inner bin 14. A small annular gap 22 is left between the base region 21 and the corresponding inner wall 23 of the outer container 2 precisely so that there is no jamming there.

The region of the inner wall 23 there extends cylindrically in order to merge into said introduction slope S at a clear distance above the base 24 of the inner bin 14.

The inner bin 14 has a standing border 25. The latter is fitted with a base ring 26 made of rubber or rubber-like plastics material (EPDM). This ring encloses the flanged end of the standing border 25 cleanly and such that it extends the surface area.

The peripheral section of the base ring 26 extends out horizontally in relation to the cylindrical wall of the inner bin 14 to a sufficient extent for the smooth annular body, that is to say base ring 26, to slide well over the introduction slope S. This prevents rattling as the inner bin is introduced or drawn out.

On the outside, that region of the wall of the outer container 2 which forms the cylindrical part of the inner wall 23 is fitted with an encircling band 27. The latter has a decorative character, on the one hand and, on the other hand, performs the task of covering the border joint 28 between the pedestal 17 and the outer container 2. Added to this is an increase in stability as a result of a double wall being provided in part there.

In the region of the opening and also to a good three quarters of the height of the inner bin 14, the introduction slope S gives rise to a relatively large annular gap 29 which is bridged by the hopper section 10. The user can reach into this annular gap in order to remove, or to introduce, the inner bin 14, which is correspondingly accessible once the head 3 has been removed. Moreover, the annular gap 29 is also used for bases extending into it and belonging to a grip depression 30 a short distance underneath the opening 8 of the outer container 2. The grip depressions 30 are disposed diametrically opposite one another, that is to say they are provided as a pair. The introduction opening 4 of the head 3 is located in the angle bisector of this pair of grip depressions.

The inner bin 14, on the one hand, may have swing-action handles on its lateral-surface wall in the vicinity of the border (not illustrated). However, the rolled upper border 13, on the other hand, is easily grippable as a result of a relatively wide bead border being achieved.

At a vertical spacing from this border 13, a round rubber ring 31 is located on the inner bin 14. This rubber ring is positioned in a circumferential groove 32 and serves for securing the folded-over border of a refuse bag 33 placed in the inner bin 14.

Figure 4:
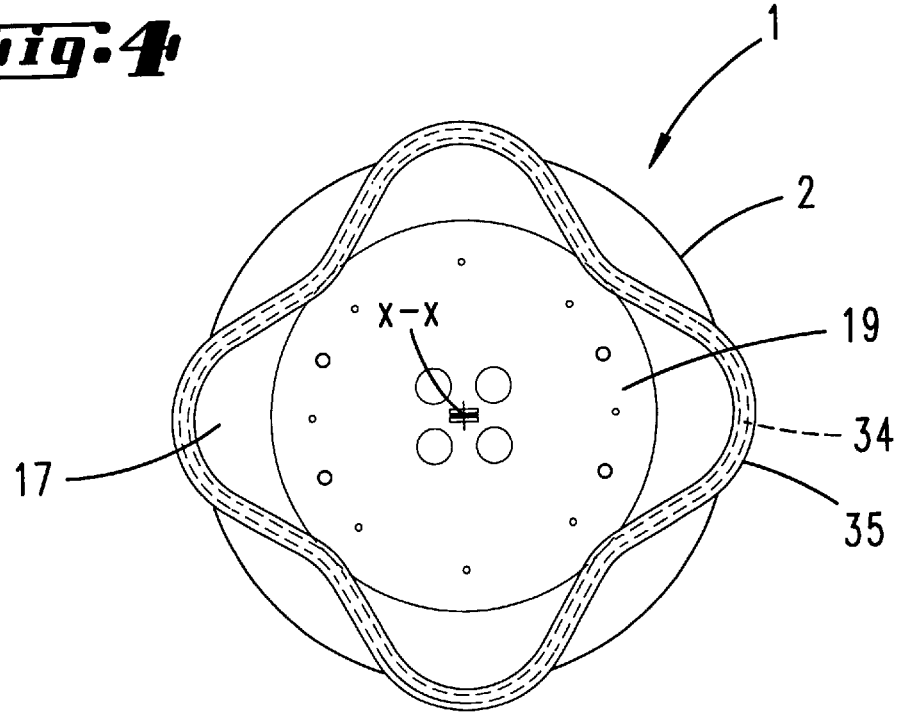
FIG. 4 shows a bottom view of the refuse container.

The standing border 34 of the pedestal 17, this border being directed toward the standing surface 19, is angled outward and, in the same way as the inner bin 14, fitted with a base ring 35, likewise made of rubber or rubber-like plastics material (EPDM). According to FIG. 4, said base ring 35 follows the wall of the pedestal 17, this wall flaring out into a wave-like border. Something of a crossed-wing profile, reminiscent of a missile, is present.

Instead of the hopper section 10 being fixed to the head 3, it is possible for two parts to be used in this respect, so that first of all the dome-like head 3 is removed, followed by the annular hopper section 10, whereupon the inner bin 14 is accessible for gripping purposes.

The basic version described in the introduction, however, provides the fixed connection of the plug-in-protrusion-like hopper section 10 to the head 3.

Riveting is used for connecting the layers which provide the partition wall 18. The corresponding rivets are designated 36. Moreover, the partition wall 18 may have ventilation openings 37. The latter are bordered by stub-like elements on the inside.

The insertion of the inner bin 14 takes place by virtue of the base region 21 being introduced roughly in the direction of the horizontal partition wall 18 of the outer container 2. The centering alignment is achieved via the cross-sectional reduction, which is clearly revealed in the direction of the reduced-diameter section 20, of the inside diameter of the outer container 2, until the inner bin is placed in position at the base end. As the inner bin 14 is fitted correctly in position on the partition wall 18, the upper border 13 of this inner bin likewise automatically assumes a center-oriented position. The head 3 is positioned with the preadjusting action of the plug-in protrusion 9, which may be formed in a sufficient length for this purpose, of the hopper section 10, the collar 12 of which forms a filling mouth which projects into the opening of the inner bin 14. The region which is located between the lateral surface of the collar 12 and the inner border of the opening of the inner bin 14 leaves sufficient clearance in order for it to be possible for the, for instance, rucked folding-over material of the refuse bag 33 to be accommodated without damage. When the refuse container 1 is carried in a sloping position, this folding-over material acts, at the same time, as a barrier against refuse dropping out. An arrangement which is improved in terms of use is achieved overall. The largest internal-diameter region of the body functions as a collecting hopper, extending inward to the smallest-internal-diameter section in the vicinity of the base.

I claim:

1. A refuse container (1) having a dome-like head (3) and an introduction opening (4) which is formed in a dome and under which a hopper section (10) is located as a refuse-introduction slope, a hopper opening (11) of which is directed toward an inner bin (14), which is disposed under the head (3), and also having an outer container (2) which accommodates the inner bin (14), wherein the outer container (2) widens in a direction of the head (3), with formation of an inner introduction slope (S), and in a base region (21) of the inner bin (14), the outer container (2) is adapted to outer dimensions of the inner bin (14), the inserted inner bin (14) overlapping (U), with an upper border (13) thereof, a collar (12) of the hopper section (10), said collar projecting into interior (15) of the inner bin (14).

2. The refuse container according to claim 1, wherein in the base region (21) of the inner bin (14), the outer container (2) forms a reduced-diameter section (20) which widens into a pedestal (17) disposed underneath.

3. The refuse container according to claim 2, wherein in a region of the reduced-diameter section (20), the outer container (2) has a horizontal partition wall (18) which supports the inner bin (14).

4. The refuse container according to claim 1, wherein in a region of a reduced-diameter section (20), the outer container (2) has a horizontal partition wall (18) which supports the inner bin (14).

* * * * *